United States Patent [19]

Touze

[11] 4,192,258

[45] Mar. 11, 1980

[54] COOLING BOXES FOR BLAST-FURNACES

[76] Inventor: François M. J. Touze, Château de Logne, 57310 Guenange, France

[21] Appl. No.: 897,504

[22] Filed: Apr. 18, 1978

[30] Foreign Application Priority Data

Apr. 27, 1977 [FR] France ..... 77 12854

[51] Int. Cl.[2] ..... F22B 37/00

[52] U.S. Cl. ..... 122/6.5; 266/190; 266/241

[58] Field of Search ..... 122/6.6 B, 6.5, 6.6, 122/6 R, 6 A; 266/190, 241

[56] References Cited

U.S. PATENT DOCUMENTS 3,628,509 12/1971 Becker et al. ..... 122/6.5

4,029,053 6/1977 Higuchi ..... 122/6.5

*Primary Examiner*—Edward G. Favors

*Attorney, Agent, or Firm*—Larson, Taylor and Hinds

[57] ABSTRACT

A box for cooling, by water circulation, the plating of blast-furnaces. This box comprises:

a nose, directed towards the inside of the blast-furnace in the mounting position of the box, made from copper or from an essentially copper based alloy and defining at least one capacity for the cooling water provided with at least one water inlet and at least one water outlet, water delivery and discharge tubes connected respectively, on the one hand, to a water supply and to a water discharge and, on the other hand, to said water inlet and outlet of the nose, and a tubular steel body surrounding said tubes, and fixed sealingly to the nose.

12 Claims, 3 Drawing Figures

COOLING BOXES FOR BLAST-FURNACES

Figure 1:
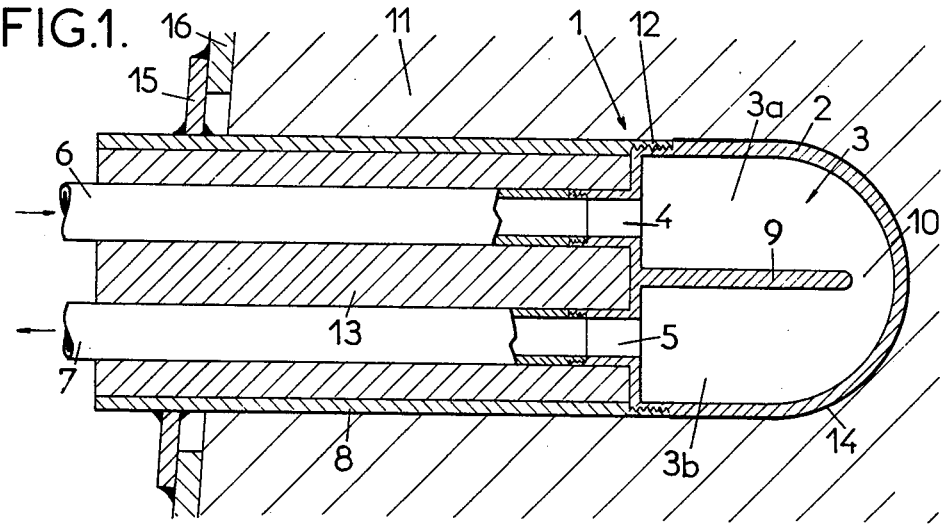

The invention concerns improvements to devices for cooling, by water circulation, the plating of blast-furnaces.

Numerous types of such devices are already known. They comprise a closed metal enclosure, having in general, but not necessarily, the shape of a truncated pyramid, mostly of rectangular cross section. The inside of this enclosure is arranged to have an inlet for cold water which is circulated then discharged after having bathed the inner wall of the enclosure.

Because of their general shape, these devices are currently called in the technique "cooling boxes" and it is this name which will be kept in the following description.

Cooling boxes have as their main purpose to prevent the steel plating of blast-furnaces from being brought to excessive temperatures which would cause weakening of their property of mechanical strength and could even lead to their destruction in a short time.

To this end, the steel plating is provided with as many openings as there are cooling boxes, and these latter are introduced through these openings so as to have their axes horizontal, and are sealingly fixed to the plating by any appropriate means (often by welding). Because of this, the largest part of each cooling box extends beyond the plating, inside the refractory brick wall. It is then the end part, or nose, of the cooling box, directed the furthest forward towards the inside of the blast-furnace, which mainly participates in the cooling, by taking the heat from the very heart of the refractory wall and by preventing the heat from propagating as far as the internal face of the plating.

Different known cooling boxes are made from steel: they are easy to manufacture and may be welded without complication to the plating of the blast-furnace and their cost price remains reasonable; but their efficiency is only mediocre because of the low heat conductivity of the steel.

Other cooling boxes are made from copper or from an alloy having a high copper content, so as to benefit from the high heat conductivity of this metal. But the principal disadvantages of these copper boxes is their very high price. Furthermore, their sealed fastening on the steel plating of the blast-furnaces is made very delicate because of the great difficulty in carrying out copper-steel weldings which are reliable; it is then necessary to have recourse to intermediate linings and special joints which further increase the cost price of the cooling installation.

Moreover, known cooling boxes have inner volumes which are too large for the cooling water to follow a given optimum path and they are the seat of vortices or other hydrodynamic disturbances which do not allow the optimum cooling of the wall to be obtained.

In other cooling boxes, in which the circulating water is channelled by pipr-runs or deflectors, the sections of the flows are not constant from the inlet to the outlet so that these boxes have not either the efficiency which is expected of them.

The invention has essentially as its aim to remove the disadvantages of the cooling boxes known up to present, by proposing a cooling box which is arranged so that the heat exchange is maximum at least in the nose of the box, which is easy to sealingly fasten to the steel plating and in which the passage sections offered to the circulating water are constant from the inlet to the outlet, while remaining robust and of a cost price less than those of copper boxes.

The cooling box of the invention is characterised in that it comprises:

- a nose, directed towards the inside of the blast-furnace in the mounting position of the box, made from copper or from an essentially copper based alloy and defining at least a capacity for the cooling water provided with at least one water inlet and at least one water outlet,
- water delivery and discharge tubes connected respectively, on the one hand, to a water supply and to a water discharge and, on the other hand, to said water inlet and outlet of the nose, and
- a tubular steel body surrounding said tubes, and sealingly fasten to the nose.

With this arrangement, only the nose (part of the box which participates for the greatest part in the heat exchange) is made of copper and the tubular body, which serves essentially only for supporting the nose and for protecting the connecting pipe-runs, is made from steel so as to reduce the cost of the cooling box and to allow its fastening by simple welding to the plating. For a cost price very much less than that of a box made entirely of copper, the cooling box of the invention has a heat exchange performance substantially identical to this latter.

Furthermore, to produce cooling boxes of different lengths, it is only necessary to provide tubular bodies of appropriate length, the copper noses being identical whatever the length of the box envisaged; it is then necessary to create only a single type of mould for moulding the noses, which simplifies accordingly the problems of manufacturing and storing the parts.

The nose and the tubular body may be of revolution, the nose then being fixed to the tubular body by screwing; but it is often advantageous for the nose to have a flattened form; the tubular body comprises then one constricted end on the nose side and the nose is fixed to the tubular body by fitting said nose into the constricted end of the tubular body and by welding the edge of said end of the tubular body to the lateral wall of the nose.

To further improve the heat exchanges and to increase the mechanical strength of the cooling box, the inner volume of the tubular body may be filled with a light good heat conducting material, particularly an aluminium alloy, surrounding said tubes.

So as to give the nose the desired shape with suitable thicknesses of metal, it is preferable that said nose be made from moulded copper or is hot-shaped.

So that the flow section for the water is constant, it is desirable that the capacity for the cooling water is tubular and has the same diameter as the water delivery and discharge tubes.

Therefore, when the nose has a flattened shape, it is possible to have it comprise several tubular capacities in the shape of the arc of a circle disposed concentrically.

It is advantageous that each tubular capacity be formed by a length of tube embedded in the copper, said length of tube and the water delivery and discharge tubes forming a single tubular piece having substantially the shape of a U. There is then no connection to be done between the water delivery and discharge tubes and the tubular capacity, and the sealing of the water circuit is thus ensured.

To protect the outer surface of the nose, particularly against the splashes of melt when the nose is partly uncovered due to wear of the refractory material, without for all that reducing its heat exchange capacity, it is advantageous that this outer surface be covered with a protecting layer formed from a material having heat resisting properties, particularly an 80% copper-20% nickel alloy.

Furthermore, to increase the speed of the heat exchanges, it is desirable for the front wall of the nose to have a lesser thickness than the side walls.

Figure 2:
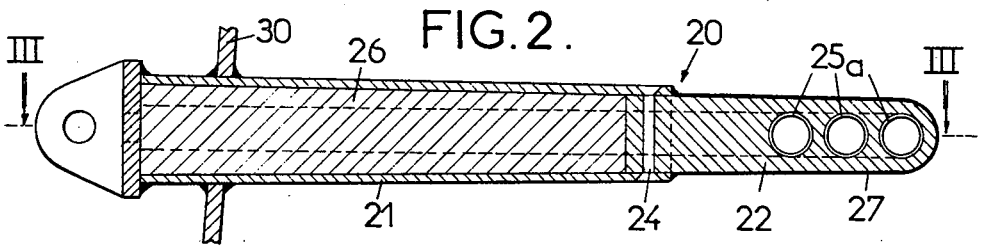
Figure 3:
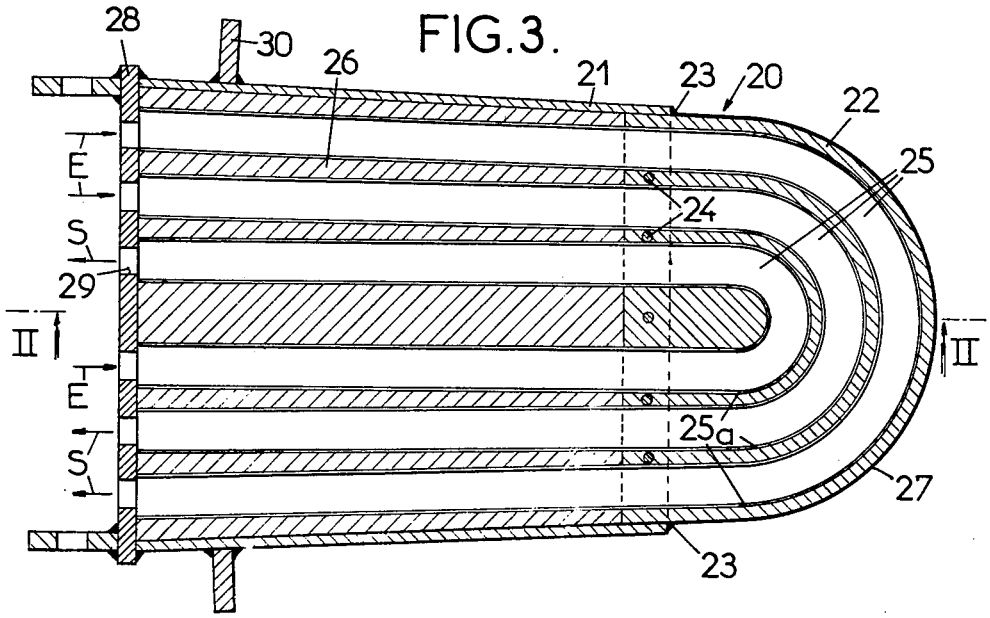

The invention will be better understood with the help of the description which follows of some embodiments given by way of illustration, but in no wise limiting. In this description reference is made to the accompanying drawings in which:

FIG. 1 is a side view, in section, of a first embodiment of the invention and FIGS. 2 and 3 are sectional views, respectively from the side and from above, of another embodiment of the invention.

As was stated above, the nose, or end part of the cooling box, occupies the forwardmost position towards the inside of the blast-furnace; it is then the part of the box which is subjected to the highest temperatures and which, for this reason, plays the most active part in the cooling of the plating of the blast-furnace. The rear part of the box, which is in contact with the plating either directly or indirectly through the fixing lining, plays a smaller part in the cooling; its essential functions are, on the one hand, to support the nose at the desired predetermined distance, in relation to the plating, for optimum cooling thereof and, on the other hand, to serve as anchorage for better holding the refractory coating disposed against the inner wall of the plating.

The result is that it is advantageous to make the nose and the rear part of the cooling box from different metals, a good heat conductor for the nose and a poorer conductor but mechanically stronger and less costly for the rear part.

To this end, the cooling box 1 according to the invention comprises essentially, as shown in FIG. 1:

a nose 2 formed from copper or from an essentially copper based alloy and defining a capacity 3 for the cooling water, this capacity being provided with a water inlet 4 and a water outlet 5;

a water delivery tube 6 connected to inlet 4 and a water discharge tube 7 connected to outlet 5;

and a tubular body 8 made from steel surrounding tubes 6 and 7 and carrying nose 2 at its end located in the blast-furnace.

The connection of tubes 6 and 7 to the nose can be simply achieved by screwing, as shown in FIG. 1.

Capacity 3 is divided by a dividing wall 9 into two chambers 3*a*, 3*b* communicating therebetween through a passage 10 situated adjacent the end of nose 2; with this arrangement the cooling water arriving through inlet 4 is compelled to hug the whole of the internal surface of nose 2 before reaching outlet 5.

Because of the simple design of the box shown in FIG. 1, it is advantageous that nose 1 is in the form of an element cylindrical in revolution having a curved front wall. Therefore the tubular body 8 is also cylindrical in revolution, or preferably in the shape of a truncated cone having its conicity turned towards the nose to facilitate the placing or the removal of box 1 in its housing provided in the heart of refractory wall 11.

The assembly of nose 2 and tubular body 8 may then be simply achieved by screwing one into the other, these two elements comprising for this purpose threads 12 at their cooperating ends.

Of course, if need be, this assembly may be achieved by fitting one into the other by force, completed by welding intended to make the unit water-tight.

To ensure the water-tightness of the box and to further improve the heat exchanges, the inner volume of tubular body 8 may be filled with a material 13, light, but a good heat conductor, surrounding tubes 6 and 7. An aluminium alloy may be used for this purpose.

The tubular body may then be formed by a section of steel tube of appropriate length and diameter, or else from a sheet of steel rolled and welded.

As for the nose, taking into account its complex shape and the relatively large thickness of its walls, it is preferably obtained by moulding. The recourse to moulding allows moreover walls to be obtained having different thicknesses; in particular, the curved part of the nose can be made thinner than the lateral wall cylindrical in revolution so as to increase the speed of the heat exchanges.

But the nose can also be manufactured by hot-shaping if this process seems more desirable.

Moreover, it is known that refractory coating 11 is subjected to substantial wear during operation of the blast-furnace and its thickness diminishes in considerable proportions. For this reason, the cooling box finishes by projecting from the refractory material and the copper nose in particular risks being subjected to considerable deterioration due particularly to the drops of molten metal falling on to the copper. The drops of melt spread out over the copper surface and cause it to melt, the heat is concentrated over an extremely reduced area, which risks causing local destruction of the copper, capable of causing water leaks requiring replacement of the box, an operation which is very delicate to achieve during operation of the blast-furnace.

To protect the copper nose, its outer surface may then be provided with a protective coating 14 having heat resistant characteristics and being sufficiently thin so as not to affect the proper operation of the box. For this purpose, an alloy is used comprising 80% copper and 20% nickel, unwettable by the drops of melt which slide over it.

FIGS. 2 and 3 show a preferred embodiment of a cooling box according to the invention and which is therefore designed according to the same general criteria as box 1 which has just been described.

Box 20 shown in these Figs. is flattened. The steel tubular body 21 has the shape of a truncated pyramid, of a rectangular cross section, converging towards nose 22.

Nose 22, made from copper or from a moulded copper alloy (or possibly hot-shaped), has side walls converging towards its curved end.

Thus, the assembly of the nose and the tubular body is achieved by fitting one into the other by force, the seal being obtained by means of a welding bead 23 extending along the edge of the tubular body.

A line of rivets 24 may also be provided for holding together the assembly of tubular body and nose.

In this embodiment, to increase the amount of cooling obtained, the box comprises several capacities 25 (Three in FIGS. 2 and 3) for the cooling water.

These capacities are formed by tubes 25*a* bent substantially in the shape of a U and disposed concentrically in relation to each other. Advantageously, copper tubes are used so as to have a good heat transmission between the copper forming the nose and the water circulating in said tubes.

To distribute the heat exchanges between the different walls of nose 22, it is provided for the cooling water to flow in different directions according to the tubes considered; for example, the water flows in the same direction in the two outer tubes and in the opposite direction in the inner tube as shown by arrows E and S in FIG. 3.

Furthermore, each tubular capacity 24 and its water delivery and discharge tubes are constructed as a single piece and they then form the legs of the U mentioned above. Thus, it is provided that the flow section of the water is constant from the inlet to the outlet, which avoids disturbances of a hydrodynamic kind and improves cooling.

In addition, there is no longer any risk of leaks occurring at the connections of the capacities and the delivery and discharge tubes and the sealing of the units is ensured.

But, of course, if need be, the screwed tube arrangement described and shown for the cooling box of FIG. 1 may be used.

As in the cae of the cooling box 1 of FIG. 1, tubular body 21 is preferably filled with an aluminium alloy 26 (or another appropriate material having equivalent characteristics) surrounding tubes 25*a* for the circulation of the cooling water and the outer surface of the copper nose is protected by a coating 27 formed by an 80% copper and 20% nickel alloy.

The rear part of the box is closed by a plate 28 (e.g. welded to the tubular body 21) provided with apertures 29 opposite the orifices of tubes 25*a* so as to connect said tubes to outside hydraulic circuits.

The cooling boxes designed in accordance with the invention provide cooling substantially equivalent to that obtained with boxes entirely constructed of copper, while being of a cost price appreciably less than that of these latter.

Furthermore, the fixing of the cooling box to the plating of the blast-furnace presents no difficulties since the tubular body and the plating are both made of steel. This fixing is advantageously achieved by welding, either by welding directly tubular body 21 to plating 30 as shown in FIGS. 2 and 3 for box 20 or by welding to the tubular body 8 a support piece 15 which is itself welded to the plating 16 as shown in FIG. 1 for box 1.

Cooling box 20, shown in FIGS. 2 and 3 and corresponding to the preferred embodiment of the invention, may be advantageously constructed according to the following process.

First of all tubes are bent in a U shape, each U having a length adapted to the length of the cooling box to be obtained and a curvature such that several (e.g. three) tubes may be disposed concentrically in relation to each other.

These tubes are held in their proper relative positions and the bases of the U's are introduced into a mould, having the outer shape of the nose, so that the legs of the U's project from the mould.

Then copper or a very high copper content alloy is poured into the mould so that the bases of the U's are embedded therein.

Then, after cooling and removal from the moulds, the nose thus obtained is introduced into a steel tubular body having the shape of a truncated pyramid, by inserting it into the end of the tubular body having the largest section.

Adjacent the other end of reduced section of the tubular body, the nose is fitted by force and the unit is held by a welding bead.

Then into the tubular body is poured an aluminium alloy which fills the inner volume of said tubular body while surrounding the tubes forming the legs of said U's.

Then the rear part of the cooling box is closed by welding a plate provided with appropriate perforations opposite the orifices of the tubes.

As is evident and as it follows moreover already from what has gone before, the invention is in no wise limited to those of its modes of application and embodiments which have been more especially considered; it embraces, on the contrary, all variations thereof.

I claim:

1. A water cooling box for a blast furnace comprising: a nose-shaped front element having walls which emborder a water cooling chamber, said front element being provided with at least one water inlet and at least one water outlet, the walls of said front element being made from copper substantially; water delivery and discharge tubes; tube connecting means for connecting the said delivery and discharge tubes with the said at least one inlet and at least one outlet of the front element, respectively; a tubular body element surrounding said delivery and discharge tubes, said tubular body element being made from steel; and coupling means for sealing coupling of said front element and tubular body element with each other.

2. A water cooling box according to claim 1 wherein said front element and said tubular body element are bodies of revolution and wherein said coupling means comprises screw means provided on the coupled ends of said elements.

3. A cooling box according to claim 1, characterised in that the front element has a flat shape, in that the tubular body element comprises a constricted end on the front element side and in that the front element is fixed to the tubular body element by fitting said front element into the constricted end of the tubular body element and by welding the edge of the tubular body element to the side wall of the front element.

4. A cooling box according to claim 3 or claim 2, characterised in that the inner volume of the tubular body element is filled with a light, good heat conducting material surrounding said tubes.

5. A cooling box according to claim 1, characterised in that the tubular body element is in the shape of a truncated cone with its conicity turned towards the front element.

6. A cooling box according to claim 1, characterised in that the front element is made from moulded or hot-shaped copper.

7. A cooling box according to claim 1, characterised in that the chamber for the cooling water is tubular and of the same diameter as the water delivery and discharge tubes.

8. A cooling box according to claim 7, characterised in that the front element several tubular chambers in the shape of an arc of a circle disposed concentrically.

9. A cooling box according to claim 8, characterised in that each tubular chamber is formed by a length of tubes embedded in the copper, said length and the corresponding water delivery and discharge tubes forming a single tubular piece having substantially the shape of a U.

10. A cooling box according to claim 9, characterised in that the single tubular piece in the shape of a U has walls of relatively small thickness.

11. A cooling box according to claim 1, characterised in that the outer surface of the front element is covered with a protective layer formed from a material having heat resistant properties.

12. A cooling box according to claim 1, characterised in that the front wall of the front element has a lesser thickness than its side walls.

* * * * *